US005510757A

United States Patent [19]

Kumar et al.

[11] Patent Number: 5,510,757

[45] Date of Patent: Apr. 23, 1996

[54] BROADBAND MINIATURE TRANSFER SWITCH MATRIX

[75] Inventors: Mahesh Kumar, Hauppauge; Michael E. Knox, Bayside, both of N.Y.

[73] Assignee: Loral Corporation, New York, N.Y.

[21] Appl. No.: 311,074

[22] Filed: Sep. 23, 1994

[51] Int. Cl.[6] ..... H01P 1/15

[52] U.S. Cl. ..... 333/104; 333/262

[58] Field of Search ..... 333/103, 104, 333/262

[56] References Cited

U.S. PATENT DOCUMENTS

| | | | |
|---|---|---|---|
| 3,138,768 | 6/1964 | Evans | 333/262 |
| 3,374,364 | 3/1968 | Concelman | 333/103 X |
| 3,982,212 | 9/1976 | Wallington et al. | 333/104 |
| 5,117,207 | 5/1992 | Powell et al. | 333/104 X |
| 5,159,296 | 10/1992 | Nelson | 333/103 |
| 5,375,257 | 12/1994 | Lampen | 333/103 X |

FOREIGN PATENT DOCUMENTS

| | | | |
|---|---|---|---|
| 2261826 | 9/1973 | Germany | 333/103 |
| 260693 | 5/1970 | U.S.S.R. | 333/103 |

*Primary Examiner*—Paul Gensler

*Attorney, Agent, or Firm*—Seymour Levine; Stanton D. Weinstein

[57] ABSTRACT

Broadband, monolithic, planar m×m and m×n transfer switches with diode switching elements are disclosed. Symmetry of the switches maintain equal insertion amplitude and phase performance. Compensation of phase unbalance caused by diode parasitic capacitance is provided by inductors serially coupled between the diodes and the input and output terminals of the transfer switch. Stripline transmission lines are utilized and isolation between the transmission lines is provide in regions of stripline cross over in the plane.

13 Claims, 4 Drawing Sheets

FIG.1.
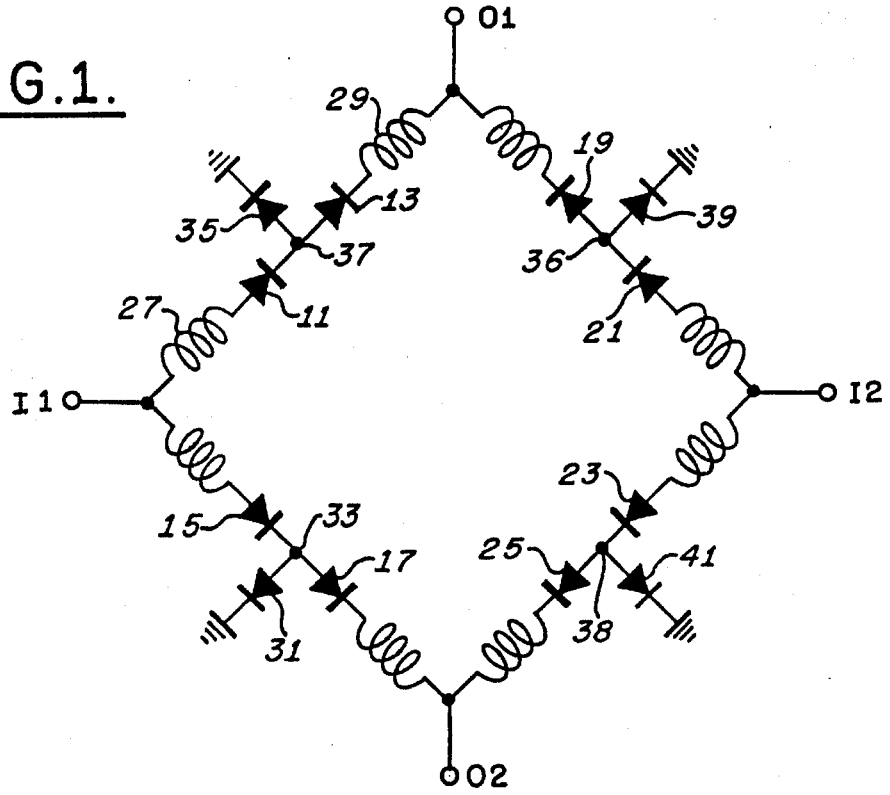
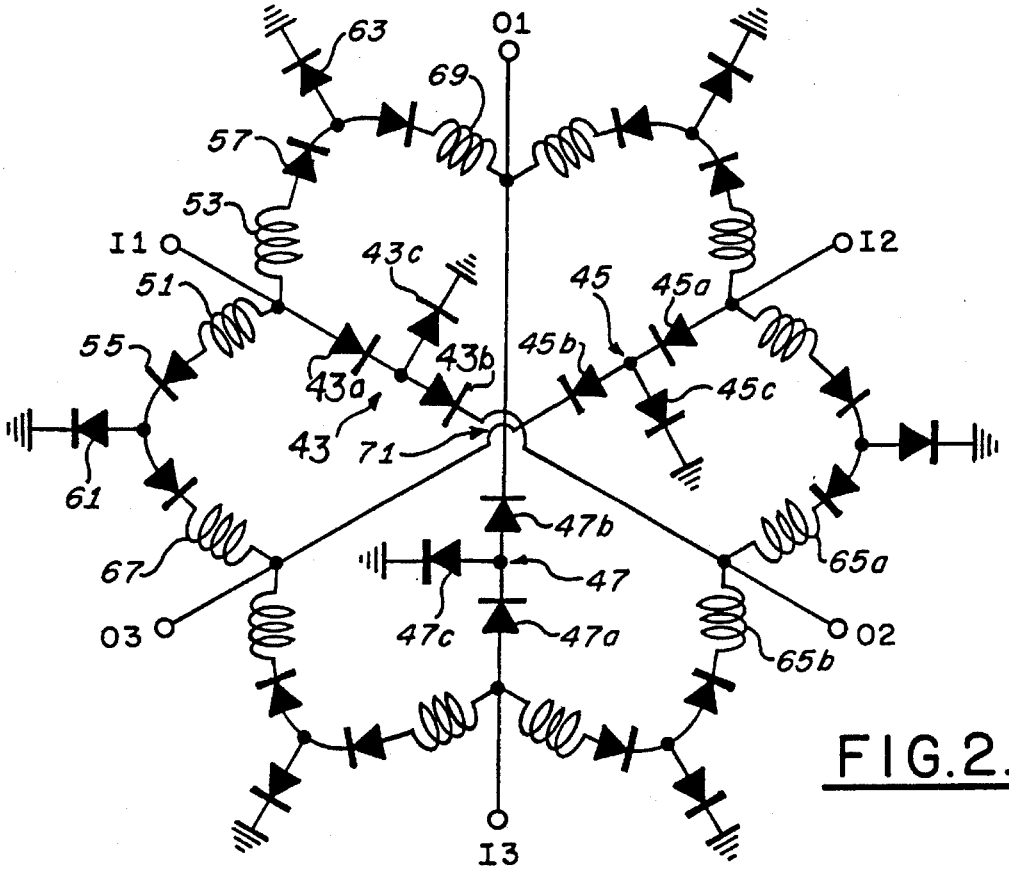
FIG.2.

BROADBAND MINIATURE TRANSFER SWITCH MATRIX

BACKGROUND OF THE INVENTION

1. Field of the Invention

The inventions pertains to the field of microwave transfer switches, and more particularly to miniaturized, broadband transfer switches that may be utilized to form a broadband microwave transfer switch matrix.

2. Description of the Prior Art

Transfer switch matrices are employed in many applications for commercial and military radar systems. Electronically scanned cylindrical array radars are being developed which electronically provide azimuthal scanning of a radar beam through a full 360°. These arrays require transfer switch matrices for activating the array elements on the cylinder surface that establish the beam at the desired azimuthal angle. Transfer switches utilized in these matrices are typically restricted to a binary number of input and output ports. This constraint adds to system complexity and curtails optimization of the antenna parameters.

To mitigate these limitations, transfer switches have been developed which provide non-binary m×n input/output switching. A number of such switches are disclosed in U.S. patent application Ser. No. 07/981,461 which is assigned to the assignee of this invention and is hereby incorporated herein by reference. These transfer switches, however, are large, heavy, expensive, and have narrow bandwidth. Additionally, these switches are configured with components on both sides of a substrate which adds to construction complexity and thereby increases the cost of the switch.

A need, therefore, exists for a transfer switch that is wideband, provides non-binary m×n input/output switching, and is relatively small, lightweight, and inexpensive.

SUMMARY OF THE INVENTION

In accordance with the present invention a monolithic m×n transfer switch utilizes combinations of 2×2 and 3×3 transfer switches. Each transfer switch in the combination is broadband and is designed such that any pairings of input terminal to output terminal may be realized. All switches in the combination are planar and are constructed in microstrip, thereby providing a planar m×n switch. Deviation from the planar construction occurs only in regions where microstrip lines must crossover. These crossovers are implemented in a manner that maintains a substantially planar configuration for the m×n switch. Grounding holes judiciously positioned between the microstrip lines involved at a crossover provide increased isolation between these lines. Symmetry within the switch maintains equal amplitude and phase performance for all input terminal to output terminal pairings.

BRIEF DESCRIPTION OF THE DRAWINGS

FIG. 1 is a schematic diagram of a planar 2×2 transfer switch which may be utilized to provide a planar m×n transfer switch.

FIG. 2 is a schematic diagram of a planar 3×3 transfer switch which may be utilized to provide a planar m×n transfer switch.

DESCRIPTION OF THE PREFERRED EMBODIMENTS

Figure 3:
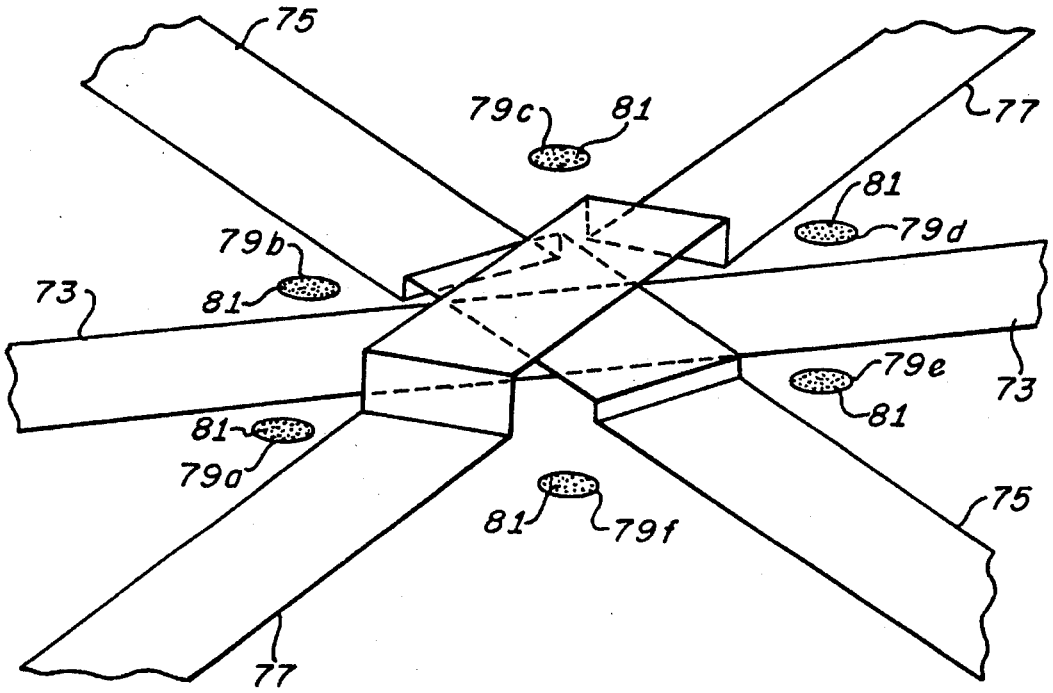
FIG. 3 is a diagram of a microstrip crossover showing therein grounding holes for improving isolation between the microstrip involved at the crossover.

Refer now to FIG. 1. Input terminal I1 is coupled to output terminal O1 via diodes 11 and 13 and to output terminal O2 via diodes 15 and 17. Similarly, input terminal I2 is coupled to output terminals O1 and O2 via the diode pairs 19,21 and 23, 25, respectively. The switch is symmetrical to provide equal amplitude and phase balance between input and output terminals. Phase balance, however, may be compromised by parasitic capacitance inherent in the diodes. To maintain phase balance, inductors of appropriate value are positioned between each diode and its adjacent terminal, as for example inductor 27 is inserted between diode 11 and the input terminal I1 and inductor 29 is inserted between diode 13 and the output terminal O1. These inductors tune out the parasitic capacitance inherent in the diodes, thereby increasing the operating bandwidth.

When input terminal I1 is coupled to output terminal O1 diodes 27 and 29 are forward biased to establish a path between I1 and O1, while diodes 15 and 17 back biased to provide an open circuit between input terminal I1 and output terminal O2. To improve the isolation between input terminal I1 and output terminal O2 a diode 31, coupled between a ground plane, not shown, on a surface opposite the switch circuitry surface, and the junction 33 of diodes 15 and 17, is forward biased to provide a short circuit to ground. A diode 35, coupled between ground and the junction 37 between diodes 11 and 13, in a manner similar to coupling of diode 31, is back biased to provide an open circuit between the junction 37 and ground. This ground connection is accomplished by providing a hole through the substrate and plating an electrical conductor through this hole that is connected to the ground plane, and the cathode of the diode. Similarly, when input terminal I2 is coupled to output terminal O2, diodes 23 and 25 are forward biased, diodes 19 and 21 are back biased, diode 39, coupled between ground and the junction 36 of diodes 19 and 21, is forwarded biased, and diode 41, coupled between ground and the junction 38 of diodes 23 and 25, is back biased. When input terminal I1 is coupled to output terminal O2 and input terminal I2 is coupled to output terminal O1 the biases described above are reversed. As for example, diodes 27 and 29 are back biased, diode 35 is forward biased, diodes 15 and 17 are forward biased, and diode 31 is back biased.

A 2×2 transfer switch constructed as above described exhibits a maximum insertion loss of 1.5 dB over a frequency range of 1 to 20 GHz with a minimum isolation between uncoupled terminals of 35 dB. Such a 2×2 transfer switch may be constructed on a substrate that is 0.06" by 0.06" by 0.008.

A monolithic 3×3 transfer switch is shown in FIG. 2. The arrangement of diodes and inductances for switching between the input terminal I1 and the output terminals O1 and O3, between input terminal I2 and output terminals O1 and O2, and between input terminal I3 and output terminals O2 and O3 is that of the 2×2 monolithic transfer switch of FIG. 1. The inductances in the 3×3 transfer switch, however, serve a function additional to that described for the 2×2 switch. This additional function will be discussed subsequently.

To complete the 3×3 switching, coupling between I1 and O2 is provided by the "T" arrangement of diodes 43*a*, 43*b*, and 43*c*, I2 and O3 is provided by the "T" arrangement of diodes 45*a*, 45*b*, and 45*c*, and I3 and O1 is provided by the "T" arrangement of diodes 47*a*, 47*b*, and 47*c*. Dedicated inductances to tune out the parasitic capacitances in the diode circuits 43, 45, and 47 are not utilized. Tuning is accomplished by selecting values for the inductances located on the perimeter of the 3×3 monolithic transfer switch circuit that compensate for the parasitic capacitances of the diodes utilized for coupling between an input terminal and its adjacent output terminals as well as the diodes utilized for coupling between an input terminal and a non-adjacent output terminal. As for example, inductances 51 and 53 are selected to tune diodes 43*a*, 55, and 57 and to partially tune diodes 43*c*, 61, and 63. Tuning of diode 43*c* is completed by the inductor combination 65*a*,65*b*, while tuning of diodes 61 and 63 is completed by inductors 67 and 69, respectively.

The coupling and decoupling between input ports I1, I2, and I3 to output ports O1, O2, and O3, respectively, is accomplished in the same manner as previously described for the input terminal-output terminal couplings of FIG. 2. For example, diodes 43*a* and 43*b* are forward biased and diode 43*c* is back biased to couple input terminal I1 to output terminal O2; diodes 43*a* and 43*b* are back biased and diode 43*c* is forward biased to decouple input terminal I1 from output terminal O2.

Continue to refer to FIG. 2. To maintain a substantially planar configuration, the microstrip lines between the input terminals I1, I2, and I3 and the output terminals O1, O2, and O3, respectively, cross, as shown at 71. Since, these lines must be decoupled for proper operation of the switch, a crossover that provides significant isolation over a broad frequency band is constructed on the substrate, as shown in FIG. 3. The microstrip line 73 between input terminal I3 and output terminal O1 may be deposited on the surface of the substrate. A first dielectric layer, not shown, may then be deposited over the microstrip line 73 in the cross over region and the microstrip line 75 between input terminal I2 and output terminal O3 may then be deposited on the substrate and over the first dielectric layer in the cross over region. This process is repeated for the microstrip line between input terminal I1 and output terminal O2. A second dielectric layer, not shown, is deposited over the microstrip line 75 and the microstrip line 77 between input terminal I1 and output terminal O2 is deposited on the substrate and over the second dielectric layer in the cross over region.

Figure 4:
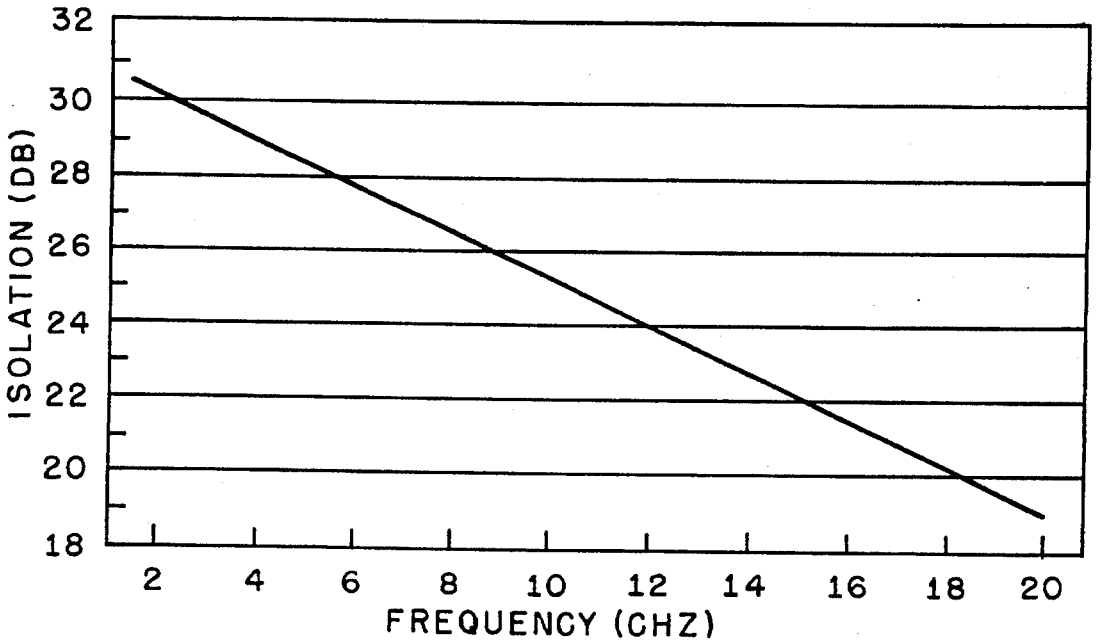
FIG. 4 is a graph of isolation vs frequency for a preferred microstrip line crossover.

Though the cross over construction described above provides isolation between the microstrip lines 73, 75, and 77 which is useful for most applications, additional isolation may be realized by providing holes 79*a*–79*f* through the substrate to a ground plane on the opposite surface of the substrate, not shown, and filling these holes, from the circuit surface to the ground plane, with a conducting material 81. The portions of the ground plane, on the surface opposite the circuit surface, is brought to the circuit surface via conducting material 81—holes 79*a*–79*f* combinations (vias) to establish a close proximity ground for each stripline in the cross over region, thereby creating a stripline-ground combination for each stripline that establishes individual transmission lines with improved isolation therebetween. A representative frequency response of the isolation between transmission lines in the cross over region is shown in FIG. 4.

The maximum insertion loss of the 3×3 transfer switch above described is 2.0 Db over a frequency band of 1 to 20 GHz with a minimum isolation of 19 Db between uncoupled terminals. Each 3×3 transfer switch can be constructed on a chip that is 0.14" by 0.14" by 0.008.

Figure 5:
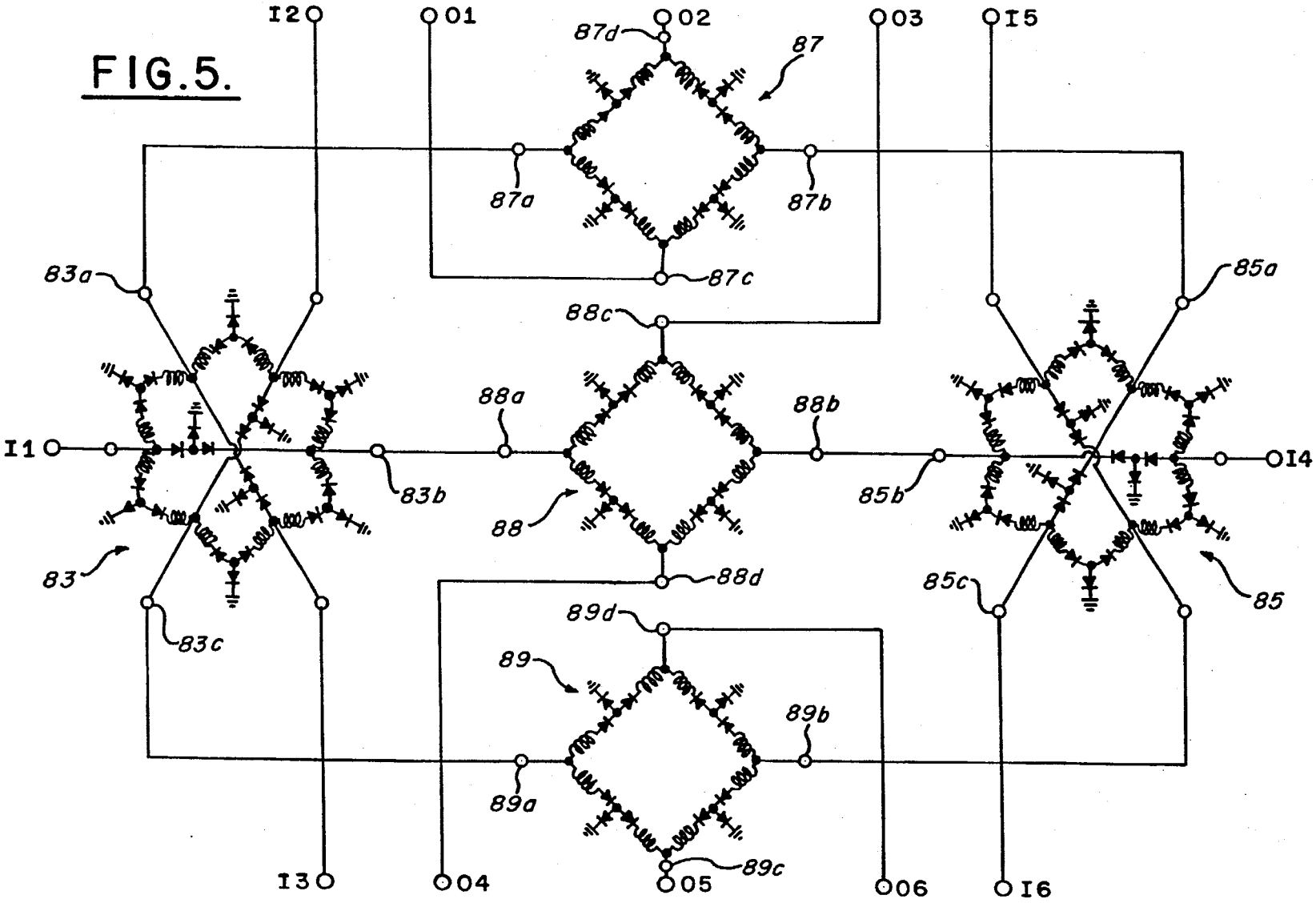
FIG. 5 is a schematic diagram of a planar 6×6 transfer switch.

The 2×2 and 3×3 transfer switches described above may be combined to obtain monolithic planar nonbinary m×n transfer switches, as for example a 6×6 transfer switch shown in FIG. 5. In this configuration, the input terminals I1–I3 are the input terminals of a first 3×3 transfer switch 83 and the input terminals I4–I6 are the input terminals of a second transfer switch 85. The output terminals 83*a*, 83*b*, and 83*c* of the 3×3 transfer switch 83 are respectively coupled to the input terminals 87*a*, 88*a*, and 89*a* of 2×2 transfer switches 87, 88, and 89. Similarly, the output terminals 85*a*, 85*b*, and 85*c* of the 3×3 transfer switch 85 are respectively coupled to the input terminals 87*a*, 87*b*, and 87*c* of the 2×2 transfer switches 87, 88, and 89. The output terminals of the 6×6 transfer switch O1 and O2 are the output terminals 87*c* and 87*d* of the 2×2 transfer switch 87, respectively; O3 and O4 are the output terminals 88*c* and 88*d* of the 2×2 transfer switch 88, respectively; and the output terminals O5 and O6 are the output terminals 89*c* and 89*d* of the 2×2 transfer switch 89, respectively.

One skilled in the art will recognize that this arrangement permits an input terminal to be coupled to any output terminal, thereby permitting all possible input terminal to output terminal sequences to be established. For example, the sequences I1–O3, I2–O6, I3–O2, I4–O4, I5–O5, I6–O1 and I1–O1, I2–O4, I3–O5, I4-O2, I5–O3, and I6–O6 are obtainable with the appropriate diode biasing.

The maximum insertion loss of the 6×6 transfer switch described above over the frequency band between 1 and 20 GHz is 3.8 dB with a minimum isolation of 20 dB between uncoupled terminals. This transfer switch may be constructed on a substrate which is 2"×1.55"×0.15", the entire switch weighing approximately 3 ounces.

It should be apparent that m×n switches where m is either a binary or non-binary number may be realized with combinations of the wide band 2×2 and 3×3 switches described above.

The switching principles described above may be employed to provide m×n transfer switches. Consider the transfer switch of FIG. 5 with the 3×3 switch 85 and the six diodes to the right of the vertical diagonal in 2×2 switches 87–89 removed. This action converts the switches 87–89 into single pole double throw (SPDT) switches and the 3×6 transfer switch shown in FIG. 6 results. The 3×3 switch 91 operates as previously described. The output terminals 91*a*, 91*b*, and 91*c* of the 3×3 transfer switch 91 are respectively coupled to the input terminals 93*a*, 94*a*, and 95*a* of the SPDT switches 93–95 which operate as previously described to couple the three input terminals to any three output terminals in all six possible permutations. Transfer switches as described above may be constructed on a substrate that is 1.0" by 1.0" by 0.15" the entire assembly weighing approximately 15 ounces These transfer switches exhibit a maximum insertion loss of 3.5 dB over a frequency range of 1.0 to 20 GHz with an isolation between uncoupled terminals that is greater than 20 dB.

Figure 6:
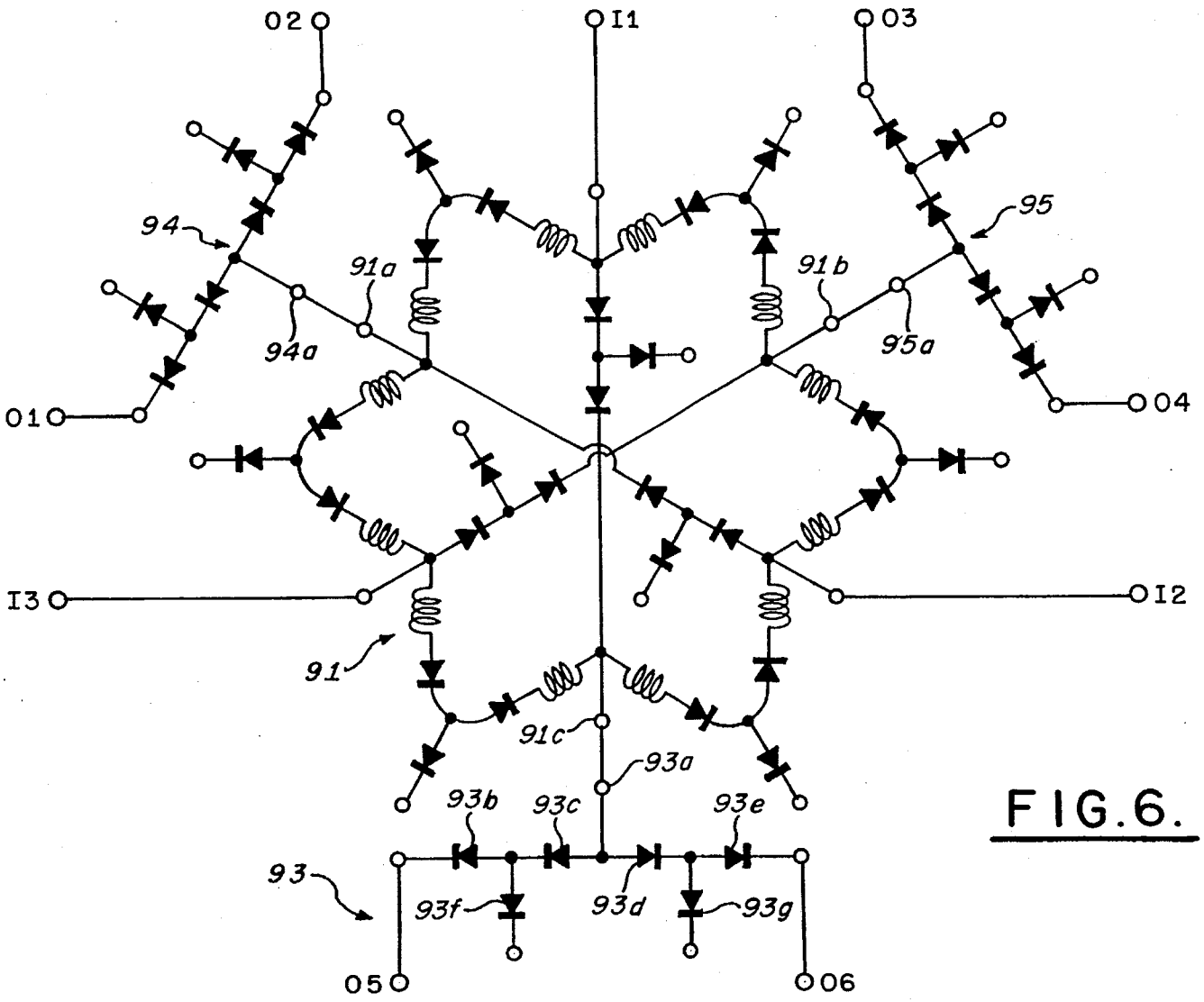
FIG. 6 is a schematic diagram of a planar 3×6 transfer switch.

The configuration of FIG. 6 also permits the three input terminals to be coupled to all six output terminals. All the cross arm diodes, as for example diodes 93*b*, 93*c*, 93*d*, and 93*e*, are forward biased while the shunt diodes, as for example diodes 93*f* and 93*g*, are back biased. This biasing couples each input terminal to pairs of adjacent output terminals, thus six permutations of output terminal pairs may be realized.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. A transfer switch comprising:

a plurality of input terminals;

a plurality of output terminals interspersed between said input terminals so that input and output terminals alternate, providing respective path segments between input and output terminals;

unidirectional current conductive devices positioned in each of said path segments and coupled between said input and said output terminals of said segments, said devices having inherent parasitic capacitance; and inductors positioned in said path segments coupled between said input terminal of said path segment and said unidirectional current conductive devices and between said output terminal of said segment and said unidirectional current conductive devices, said inductor tuning out said parasitic capacitance of said unidirectional current conductive devices to maintain phase balance.

2. A transfer switch in accordance with claim 1 wherein said plurality of input terminals number two, said plurality of output terminals number two and said unidirectional current conductive devices are diodes.

3. A transfer switch in accordance with claim 2 wherein:

said inductors in each said segment include first and second inductors, said first inductor having a first terminal coupled to said input terminal and a second terminal, said second inductor having a first terminal coupled to said output terminal and a second terminal;

said diodes number three and are arranged such that a first diode has a first terminal coupled to said second terminal of said first inductor and a second terminal coupled to a second terminal of a second diode, said second diode having a first terminal coupled to said second terminal of said second inductor, and a third diode coupled to said second terminals of said first and second diodes.

4. A transfer switch in accordance with claim 1 including further path segments between each input terminal and an output terminal positioned between two other input terminals and further comprising:

further unidirectional current conductive devices respectively coupled between said input terminal and said output terminal of said further path segments.

5. A transfer switch in accordance with claim 4 wherein:

said plurality of input terminals number 3, said plurality of output terminals number 3, and said unidirectional current conductive devices are diodes in a first arrangement and said further unidirectional current conductive devices are diodes in a second arrangement.

6. A transfer switch in accordance with claim 5 wherein:

said inductors in each said segment include first and second inductors, said first inductor having a first terminal coupled to said input terminal and a second terminal, said second inductor having a first terminal coupled to said output terminal and a second terminal;

said first arrangement of diodes number three and are arranged such that a first diode has a first terminal coupled to said second terminal of said first inductor and a second terminal coupled to a second terminal of a second diode, said second diode having a first terminal coupled to said second terminal of said second inductor, and a third diode coupled to said second terminals of said first and second diodes; and said second arrangement of diodes number three and are arranged such that a first diode has a first terminal coupled to said input terminal and a second terminal, a second diode has a second terminal coupled to said second terminal of said first diode and a first terminal coupled to said output terminal positioned between said two other input terminals, and a third diode is coupled to said second terminals of said first and second diodes.

7. A transfer switch in accordance with claim 6 wherein said path segments and said further path segments comprise microstrip line transmission lines formed on a surface of a substrate having a ground plane on a surface opposite said surface, said microstrip line transmission lines in said further path segments crossing over one another in a cross over region, and further including means for providing isolation between said stripline transmission lines in said crossover region.

8. A transfer switch in accordance with claim 7 wherein said isolation means includes electrical conductive material filling holes in said substrate, said holes positioned between microstrip line transmission lines in said cross over region and extending from said surface to said ground plane.

9. A transfer switch in accordance with claim 4 further including SPDT switches having input terminals respectively coupled to said output terminals.

10. A transfer switch in accordance with claim 9 wherein:

said plurality of input terminals number 3, said plurality of output terminals number 3, and said unidirectional current conductive devices are diodes in a first arrangement and said further unidirectional current conductive devices are diodes in a second arrangement.

11. A transfer switch in accordance with claim 10 wherein:

said inductors in each said segment include first and second inductors, said first inductor having a first terminal coupled to said input terminal and a second terminal, said second inductor having a first terminal coupled to said output terminal and a second terminal;

said first arrangement of diodes number three and are arranged such that a first diode has a first terminal coupled to said second terminal of said first inductor and a second terminal coupled to a second terminal of a second diode, said second diode having a first terminal coupled to said second terminal of said second inductor, and a third diode coupled to said second terminals of said first and second diodes; and said second arrangement of diodes number three and are arranged such that a first diode has a first terminal coupled to said input terminal and a second terminal, a second diode has a second terminal coupled to said second terminal of said first diode and a first terminal coupled to said output terminal positioned between said two other input terminals, and a third diode is coupled to said second terminals of said first and second diodes.

12. A transfer switch in accordance with claim 6 wherein said path segments and said further path segments comprise microstrip line transmission lines formed on a surface of a substrate having a ground plane on a surface opposite said surface, said microstrip line transmission lines in said further path segments crossing over one another in a cross over region, and further including means for providing isolation between said stripline transmission lines in said crossover region.

13. A transfer switch in accordance with claim 12 wherein said isolation means includes electrical conductive material filling holes in said substrate, said holes positioned between microstrip line transmission lines in said cross over region and extending from said surface to said ground plane.

* * * * *